United States Patent [19]

Bauer et al.

[11] Patent Number: 4,843,947

[45] Date of Patent: Jul. 4, 1989

[54] RIOT SHIELD

[76] Inventors: Eran N. Bauer; Gerard M. Bauer, both of The Old Rectory, Vicarage La., Wellingore, Lincoln, England

[21] Appl. No.: 70,586

[22] Filed: Jul. 7, 1987

[30] Foreign Application Priority Data

Jul. 8, 1986 [GB] United Kingdom ..... 8616567

[51] Int. Cl.[4] ..... F41H 5/08

[52] U.S. Cl. ..... 89/36.05; 2/2.5; 109/49.5

[58] Field of Search ..... 89/36.05, 36.02, 36.07, 89/36.01; 109/49.5; 2/2.5

[56] References Cited

U.S. PATENT DOCUMENTS

| | | | |
|---|---|---|---|
| 36,781 | 10/1862 | Hunter | 89/36.05 |
| 377,732 | 2/1888 | Adams | 89/36.05 |
| 1,279,571 | 9/1918 | Moloney | 89/36.05 |
| 3,476,107 | 11/1969 | Matt, Jr. et al. | 89/36.02 |
| 4,245,546 | 1/1981 | Chaires | 109/49.5 |
| 4,674,394 | 6/1987 | Martino | 89/36.05 |
| 4,760,611 | 8/1988 | Huet et al. | 2/2.5 |

FOREIGN PATENT DOCUMENTS

| | | | |
|---|---|---|---|
| 2412568 | 9/1975 | Fed. Rep. of Germany | 89/36.05 |
| 2741180 | 3/1979 | Fed. Rep. of Germany | 2/2.5 |

*Primary Examiner*—Deborah L. Kyle
*Assistant Examiner*—Daniel Wasil
*Attorney, Agent, or Firm*—Burns, Doane, Swecker & Mathis

[57] ABSTRACT

A riot shield comprising a planar shield member (1), and at least one handle (3,4), secured to the back of the shield member (1). Integral linking means (5,6), is provided on each of two opposing sides of the shield member (1) whereby the shield member (1) can be releasably interlinked with the integral linking means of a second riot shield.

8 Claims, 2 Drawing Sheets

RIOT SHIELD

DESCRIPTION

The present invention relates to a riot shield and, in particular, to a riot shield which can be used in combination with a plurality of other riot shields to form a strong, secure and effective defensive wall between riot control officers and rioters.

Ever increasingly, disputes between, and grievances held by sections of society are being openly aired by demonstrating on the streets. Whenever these demonstrations deteriorate into riots and civil disorders it is the police who are called upon to control the situation and impose law and order. The police are not expected to use excessive force against the rioters, and yet they may be subjected to direct physical attack and have hails of missiles and projectiles thrown at them. It is not unknown for fire bombs and even firearms to be used against the police by the rioters.

An important item of equipment in the police's armoury against the rioters is the riot shield. Essentially, a riot shield consists of a polycarbonate sheet having two handles secured to the back of it which enable an officer to carry the riot shield on his left arm, whilst leaving his right arm free. Polycarbonate material is lightweight, yet tough and very shock resistant. It is also fire resistant. In addition, it can be transparent. All of these features make it ideally suited to use as a riot shield—it affords good protection against attack, either directly or by missiles and projectiles, whilst being easily carried, and allows an officer to see the situation faced through it.

An officer equipped with a riot shield can protect himself from attack, and to a certain extent he can protect brother officers behind him not equipped with riot shields. However, working alone with a riot shield an officer is always vulnerable to attack from the side or from behind. Accordingly, officers are now trained to work as a group in a riot situation and to use their riot shields to secure a tactical advantage over the rioters. Those officers in the first few ranks of a company are equipped with riot shields which they use to form a defensive wall between themselves and the rioters. Those officers not equipped with riot shields shelter behind the officers holding up the defensive wall and follow the wall into the rioters to imposed control and restore peace on the situation. In this respect, the wall affords complete protection as the officers move into the rioters and allows them to adopt various tactical formations such as wedges, pincer movements, etc. An example, of one such tactical move facilitated by the use of riot shields to form a defensive wall is that of a snatch to take trouble makers and ringleaders out of the riot. A snatch squad of officers shelters behind the defensive wall and when an opportunity presents itself a section of the defensive wall is opened to allow the snatch squad through. Once the snatch is completed the officers can return through the opening with their prisoner and the opening is then closed to prevent other demonstrators from following the snatch squad through.

In order to work effectively as a defensive wall the edges of adjacent riot shields are allowed in use to overlap each other. However, in the absence of any securing means it will always be possible for rioters in large enough numbers to separate the riot shields and break through the defensive wall to attack the officers behind. At the present time, and using conventional riot shields, the police must try to keep the riot shields together by bracing them against the ground.

It is an object of the present invention to provide a riot shield which can be releasably secured to another riot shield on each side to form a strong secure and effective defensive wall.

According to a first aspect of the present invention there is provided a riot shield comprising a planar shield member and at least one handle secured to the back of the shield member, wherein integral linking means is provided on each of two opposing sides of the shield member, whereby the shield member can be releasably interlinked with the linking means of a second riot shield.

Preferably, each linking means comprises an open channel section integrally formed in a side of the shield member, which channel section opens towards the back of the shield member, and locking means which lies in or over the open channel section and is adapted in use to lock the open channel section of a second riot shield in the said open channel section.

In use two or more riot shields are secured together by slipping the channel section of one riot shield into the channel section of the other riot shield and locking it there with the locking means. The channel sections of adjacent shields are connected together from the rear of the shields and as such it is relatively easy for officers to engage and to disengage their riot shields, although it is virtually impossible for the rioters pressing on the front of the riot shields to separate them by breaking the locking means.

Preferably, the shield member is comprised of a polycarbonate sheet and the channel sections are pressed into two opposing sides thereof. However, it will be appreciated that other materials, such as mild steel, fibreglass, etc. may be used, provided they are suitably tough and shock resistant.

The actual dimensions of the polycarbonate sheet are not crucial, but generally it must be tall enough to afford protection from the top of a user's head to his knees and wide enough to extend beyond his shoulders on each side. Generally speaking the shield will be rectangular in shape with the open channel shaped sections extending the length of each longest side. To prevent torsional twisting of the shield member a reinforcing plate may be secured to the back of it and this too can be formed of polycarbonate material. In addition to preventing torsional twisting of the shield member the reinforcing plate also gives the riot shield increased strength and resistance to projectiles and missiles. Preferably, the reinforcing plate is secured to the shield member by the same fastening means used to secure the handles in position.

In a preferred embodiment of the present invention the width of the reinforcing plate is such that each of two of its edges extend part way over the open channel section. In this way the edges of the reinforcing plate provide a tang against which the leading edge of the channel section of a second riot shield can brace and be locked. To assist the locking action of the edge of the reinforcing plate it may be bent over to provide a hook behind and against which the leading edge of the channel section of the second riot shield can be located.

It will be appreciated that other locking mechanisms may also be used of lesser or greater sophistication. However, whatever the form of the locking means itself it should be born in mind that it must secure the channel section of a second riot shield within the channel section it is associated with, but still facilitate quick and easy disengagement of the two channel sections from each other. For this reason sophisticated locking mechanisms consisting of slots and clips, although falling with the scope of the present invention, may not be quite as suited to the purpose in hand as the simple tang provided by the edge of the reinforcing plate.

Preferably, the channel section is of substantially semi-circular cross-section, however other cross-sections can be envisaged, such as square, triangular and composite.

An embodiment of the present invention will now be described, by way of example, with reference to the accompanying drawings, in which.

Figure 2:
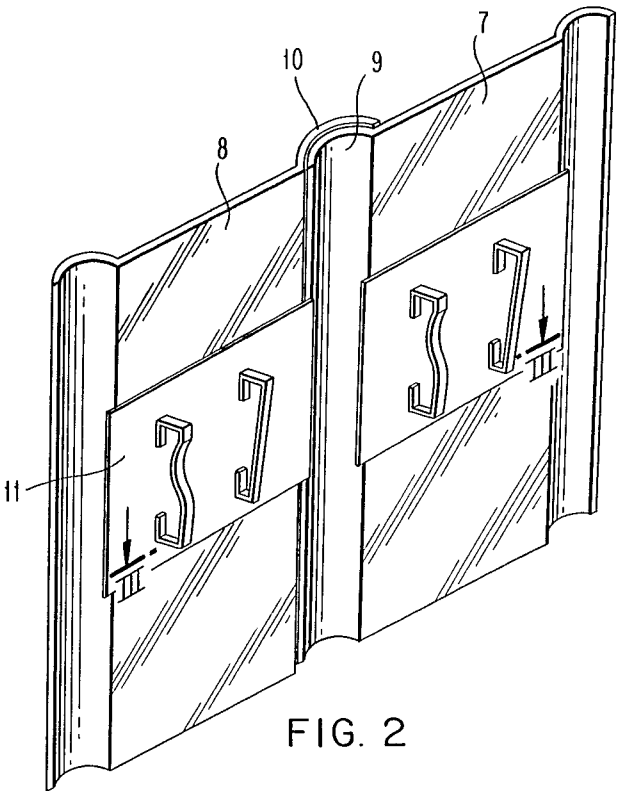
FIG. 2 shows a perspective view of two of the riot shields of FIG. 1 connected together.
Figure 1:
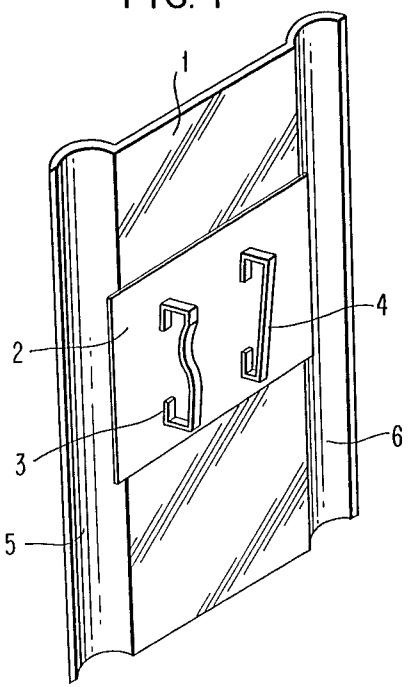
FIG. 1 shows a perspective view of a riot shield embodying the present invention.
Figure 3:
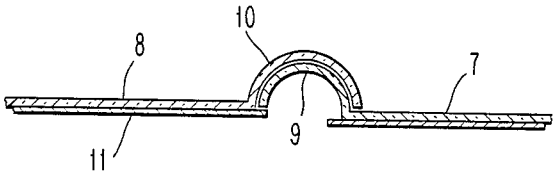
FIG. 3 shows a cross-section along lines III—III of FIG. 2.
Figure 4A:
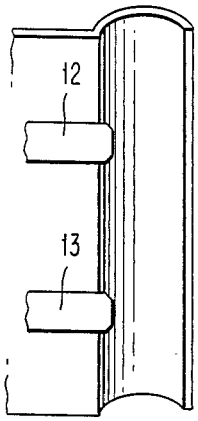
Figure 4B:
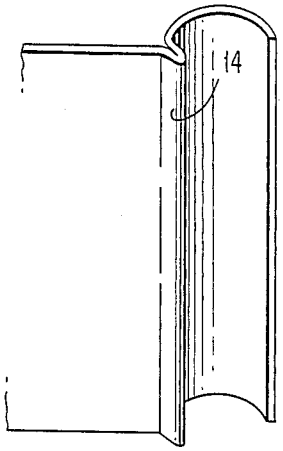
Figure 4C:
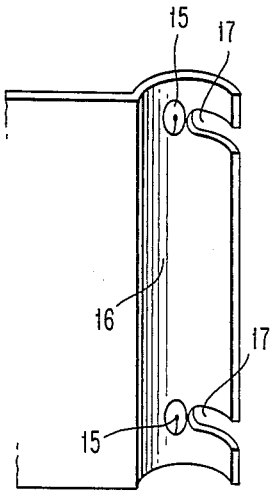
Figure 4D:
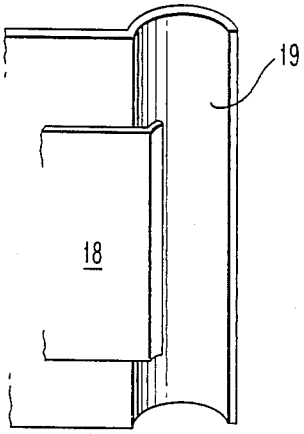

FIGS. 4(*a*) to 4(*d*) shows a number of alternatives to the linking means shown in FIGS. 1, 2 and 3.

Referring to FIG. 1 of the accompanying drawings there is shown a riot shield comprising a rectangular shield member 1, a reinforcing plate 2 and two handles 3 and 4. The shield member 1 is formed from a sheet of lightweight tough, shock resistant material, such as polycarbonate. This can be transparent which makes it ideally suited to use in a riot shield where the user must be able to see beyond the riot shield without giving up the protection it affords. Moreover, high quality polycarbonate of between 2 to 5 mm thickness has been shown to be capable of stopping most of the projectiles and missiles likely to be used by rioters. Indeed, it can even stop bird shot and small calibre bullets. The dimensions of the shield member 1 are not crucial, but generally the shield member should be tall enough to extend from above the user's head to his knees and be wide enough to extend beyond his shoulders on each side.

A channel section 5, 6 of essentially semicircular cross-section is formed on each side of the shield member 1 between the top and the bottom. The open side of each channel section 5, 6 faces towards the back of the shield member 1.

The reinforcing plate 2 is also comprised of a sheet of lightweight, tough, shock resistant material such as polycarbonate. It is secured to the back of the shield member 1 by means of the same fasteners (not shown) used to secure the handles 3, 4 to the shield member 1. In fact, the reinforcing plate 2 is sandwiches between the shield member 1 and the handles 3, 4. The reinforcing plate 2 gives additional strength and rigidity to the shield member 1 about its centre and reduces torsional twisting of the shield member 1 which tends to make it difficult to hold steady. The width of the reinforcing plate 2 is such that it extends part-way over the top of each channel section 5, 6 on each side of the shield member 1.

The handles 3 and 4 secured to the back of the shield member 1 are spaced apart so that a user can pass his forearm through one and grip the other with his hand. This allows the user to carry the riot shield easily and comfortably, whilst leaving the other arm free.

Referring now to FIGS. 2 and 3 there is shown a pair of riot shields 7 and 8 connected together along their adjacent edges. In this respect, the channel section 9 of riot shield 7 is engaged in the channel section 10 of riot shield 8. In this position the leading edge of channel section 9 abuts against the back of the reinforcing plate 11 of riot shield 8. If one or other of the two riot shields 7 and 8 is moved back relative to the other then the channel sections 9 and 10 will disengage from each other and the riot shields 7 and 8 will separate. However, if both riot shields 7 and 8 are moved backwards or forwards together channel section 9 will remain in tight abutment with the back of the reinforcing plate 11, locking the channel section 9 within channel section 10 and preventing the riot shields 7 and 8 from separating except through the use of sheer brute force.

It will be appreciated that by connecting together a plurality of riot shields in the way outlined above a very strong and secure defensive wall can be formed which can in the normal course of things, only be separated by the deliberate action of the users. Rioters or demonstrators pushing against the front of the defensive wall will only serve to increase the strength of the interlock between adjacent riot shields.

In addition to being interlocked side to side the riot shields embodying the present invention can also be interlocked along the top of a defensive wall comprised of riot shields. In this respect, the top edge of a riot shield can be locked between the channel section and the edge of the reinforcing plate of a riot shield positioned above and at right angles to it. This arrangement does not provide as strong an interlock as the interlocking channel sections described hereinabove. However, it does allow the height of the defensive wall to be increased and a roof to be extended back over the officers from the defensive wall.

Referring now to FIGS. 4(*a*) to 4(*d*) there are shown a number of alternative arrangements for interlocking adjacent riot shields together.

In FIG. 4(*a*) the single locking means provided by the edge of the reinforcing plate is replaced by two spaced locking means 12, 13. These act in the same way as the edge of the reinforcing plate, but can be provided where a reinforcing plate is not present. It is envisabed that the locking means would be provided by cross members on which the handles are mounted.

In FIG. 4(*b*) the locking means is formed by moulding the inside edge of the channel section 14 to extend into the channel section itself.

In FIG. 4(*c*) there is shown a riot shield in which the locking means comprises two clips 15 located within the channel section 16. The clips engage in slots 17 in the channel section of another riot shield to secure the two together. It is possible to vary the number of clips and slots, but generally speaking this arrangement is not preferred because of the expense involved in fixing the clips and forming the slots. Also it is not an especially strong arrangement.

FIG. 4(*d*) shows a locking mechanism comprising a plate 18 secured adjacent the channel section 19 of the riot shield. The plate 18 may form an extension of the backing plate, if one is provided, but this is not crucial. The free edge of the plate 18 is bent at an angle to the main body of the plate 18 to form a hook which projects into the channel section. When two channel sections are engaged together the leading edge of the inside channel section slips behind the hook which thus prevents it from moving laterally out of the outer channel section.

We claim:

1. A riot shield comprising a planar shield member and at least one handle secured to a rear face of the shield member whereby the riot shield can be held in use, wherein an open channel shaped section is provided along each of two opposite sides of the shield member, each of which open channel shaped sections is adapted, in use, to link with an open channel shaped section of a corresponding riot shield, and locking means provided in or adjacent to each open channel shaped section which, in use, releasably secures the open channel shaped section of the corresponding riot shield within the open channel shaped section.

2. A riot shield comprising a planar shield member and at least one handle secured to a rear face of the shield member whereby the riot shield can be held in use, wherein an open channel shaped section is provided along each of two opposite sides of the shield member, each of which open channel shaped sections is adapted, in use, to link with an open channel shaped section of a corresponding riot shield, and locking means provided in or adjacent to each open channel shaped section which, in use, releasably secures the open channel shaped section of the corresponding riot shield within the open channel shaped section, said locking means comprising an abutment surface which lies in or over a mouth of the channel shaped section, such that in use the channel shaped section of a corresponding riot shield lies between facing surfaces of the channel shaped section and its associated locking means, with a leading edge thereof abutting and braced against the locking means.

3. A riot shield according to claim 1, wherein the locking means comprises a hook portion which engages with a leading edge of the channel shaped section of a corresponding riot shield.

4. A riot shield according to claim 1, wherein the shield member is comprised of a polycarbonate sheet and the channel shaped sections are pressed into two opposing sides thereof.

5. A riot shield according to claim 1, wherein a reinforcing plate is secured to the rear face of the shield member.

6. A riot shield according to claim 5, wherein the reinforcing plate is secured to the shield member by fastening means which also serve to secure said at least one handle thereto.

7. A riot shield comprising a planar shield member and at least one handle secured to a rear face of the shield member whereby the riot shield can be held in use, wherein an open channel shaped section is provided along each of two opposite sides of the shield member, each of which open channel shaped sections is adapted, in use, to link with an open channel shaped section of a corresponding riot shield, and locking means provided in or adjacent to each open channel shaped section which, in use, releasably secures the open channel shaped section of the corresponding riot shield within the open channel shaped section, said locking means including a reinforcing plate secured to the rear face of the shield member and extending into or over the open channel shaped section to provide a tang against which a leading edge of the channel section of a corresponding riot shield can brace and be locked.

8. A riot shield according to claim 7, wherein edges of the reinforcing plate extending into or over the open channel shaped section are bent over to provide a hook behind and against which the leading edge of the channel section of a corresponding riot shield can be located.

* * * * *